United States Patent [19]

Nylund

[11] 4,412,362

[45] Nov. 1, 1983

[54] PARTIAL FLUSH APPARATUS UTILIZING PNEUMATIC TIME DELAY MECHANISM

[76] Inventor: Kenneth G. Nylund, Rte. 1, Box 40C, Globe, Ariz. 85501

[21] Appl. No.: 225,390

[22] Filed: Jan. 15, 1981

[51] Int. Cl.[3] ..... E03D 1/34

[52] U.S. Cl. ..... 4/388; 4/360; 4/415

[58] Field of Search ..... 188/289, 322.22, 284, 188/317; 4/249, 360–362, 379, 388, 407, 415, 426

[56] References Cited

U.S. PATENT DOCUMENTS

| | | | |
|---|---|---|---|
| 407,397 | 7/1889 | Eldridge | 4/388 |
| 496,572 | 5/1893 | Lewis | 4/388 |
| 1,069,658 | 8/1913 | Drew | 4/388 X |
| 1,957,308 | 5/1934 | Anderson | 188/289 X |
| 2,423,736 | 7/1947 | Tack | 188/289 X |
| 2,953,810 | 9/1960 | Hall | 188/317 X |
| 3,052,328 | 9/1962 | Brueckner | 188/289 |
| 3,078,499 | 2/1963 | Gray et al. | 188/289 X |
| 3,625,320 | 12/1971 | Doetsch et al. | 188/317 X |
| 4,138,749 | 2/1979 | Clark | 4/388 |
| 4,166,612 | 9/1979 | Freitag et al. | 188/284 X |
| 4,221,367 | 9/1980 | Smith | 188/284 X |
| 4,273,220 | 6/1981 | Tilkens | 188/289 X |

*Primary Examiner*—Charles E. Phillips

*Attorney, Agent, or Firm*—Cahill, Sutton & Thomas

[57] ABSTRACT

A partial flush apparatus, for use in conjunction with a conventional flush toilet, utilizes a pneumatic time delay mechanism for partially flushing the contents of the water tank into the toilet bowl. An extension member is secured to the conventional flush handle lever arm and a cable extends between the extension member and a plunger of the pneumatic time delay mechanism. When depressed, the plunger lifts the extension member and thereby partially opens a flapper valve at the bottom of the water tank for a predetermined time. The pneumatic time delay mechanism includes a spring for biasing the plunger to a released position after the plunger has been depressed. The plunger incoporates a one-way valve for facilitating movement of the plunger to the depressed position. The plunger also includes a longitudinal bore forming part of a fluid conducting path that controls the return of the plunger to the released position. An adjustable metering rod is received by the longitudinal bore for initially restricting the flow of fluid therethrough.

14 Claims, 3 Drawing Figures

PARTIAL FLUSH APPARATUS UTILIZING PNEUMATIC TIME DELAY MECHANISM

BACKGROUND OF THE INVENTION

1. Field of the Invention

The present invention relates generally to an apparatus for partially flushing the contents of a water tank into a toilet bowl, and more particularly, to such an apparatus that employs a pneumatic time delay mechanism to open the drain valve of the water tank during a partial flush.

2. Description of the Prior Art

It has generally been recognized that conventional toilet flushing mechanisms are wasteful as they often utilize a greater quantity of water to flush the toilet bowl than is actually required. Typically, liquid waste can be adequately flushed from the toilet bowl using only a fraction of the water stored within the water storage tank. The large amount of water wasted due to the inefficiency of conventional toilet flushing mechanisms places an undue burden on water procurement and sewage treatment plants and results in unnecessarily high water bills for homeowners.

In order to reduce the amount of water wasted by conventional toilet bowl flush mechanisms, many prior art devices are known for selectively decreasing the quantity of water that is used to flush the toilet bowl. One general type of prior art mechanism that selectively flushes only a fraction of the water stored in the tank utilizes multiple flush valves disposed at different heights within the water tank. For example, in U.S. Pat. No. 3,795,016, a flush mechanism is described wherein a first flapper valve is disposed at the bottom of the tank and a second flapper valve is disposed midway between the top and bottom of the tank; two handles are provided, the first handle controlling a first lever arm for opening only the second flapper valve, and the second handle controlling a second lever arm for opening both flapper valves. Although the devices utilizing multiple flush valves are helpful in conserving water, installation of such devices within existing toilets typically requires extensive modification of the flush mechanism already present. The complexity of the required modifications makes it difficult for homeowners to install such devices by themselves and therefore detracts from the marketability of these devices.

A second type of water conserving flush mechanism is also known in the art wherein a float operated member, in response to the falling water level within the tank, pushes the flush valve closed before all of the water has drained from the tank. A flush mechanism of this general type is disclosed in U.S. Pat. No. 4,032,997. However, if the user desires to fully flush the contents of the water tank into the toilet bowl, the user is typically required to either hold the flush handle down for a relatively long time or operate a separate latch mechanism in order to defeat the partial flush float operated mechanism.

A third type of water saving flush mechanism is also known in the art wherein a timing mechanism is utilized to force the conventional flush valve closed after a predetermined time has passed. For example, in U.S. Pat. No. 4,138,749, a two-stage hydraulic flush device is disclosed wherein operation of the conventional flush handle moves a piston within a hydraulic cylinder submersibely disposed within the water tank. When the flush handle is released, water is expelled from the cylinder at a controlled rate as the piston is forcibly returned by a spring to its initial position. In order to obtain a large flush, the user rotates the flush handle beyond a partial flush position to a full flush position, thereby causing the piston within the hydraulic cylinder to be displaced a greater distance than in the partial flush mode. The drain valve is coupled to the lifting arm by a rigid lifting rod so that the drain plug is reseated only after the piston returns to its initial position. Because the hydraulic flush device is submersed within the water tank, several of the components within the device are subject to corrosion. Furthermore, any adjustments to the time delay provided by the two stage hydraulic flushing device can be made only by accessing components thereof that are inconveniently disposed below the water level of the tank.

In addition, U.S. Pat. No. 4,014,050 discloses a flushing mechanism utilizing a timer for conrolling the quantity of water drained from the water tank. The device disclosed by this patent includes a crank coupled to the shaft of a timer for rotating the shaft through a predetermined angle. The shaft of the timer rotates a mechanical linkage for raising and lowering a rigid lifting rod connected to the flush valve. The time for which the flush valve is open corresponds to the angle through which the crank is rotated. However, in order to install such a device within an existing conventional toilet, substantial modification of the flush mechanism is required. Furthermore, neither of the devices disclosed by U.S. Pat. Nos. 4,138,749 and 4,014,050 appear to be compatible with water tanks utilizing a flapper valve operated by a flexible linkage or chain since, in both cases, the timing mechanism must apply a downward force, via the rigid lifting rod, to the drain valve in order to close it.

Moreover, the devices disclosed in above referenced U.S. Pat. Nos. 4,138,749 and 4,014,050 each impair the operation of the flush mechanism typically provided in a conventional toilet when a full flush is desired. The conventional flush mechanism operates to reseat the flush valve at the instant that substantially all of the water has drained from the storage tank since, at that instant, the drain valve is no longer buoyantly supported above the drain valve seat. However, prior art flush mechanisms incorporating a timer may result in the flush valve remaining open even after the point at which substantially all of the water stored within the tank has drained therefrom; in this event, water subsequently discharged into the tank in order to refill the tank is instead drained into the toilet bowl until the timing mechanism eventually allows the flush valve to reseat.

Accordingly, it is an object of the present invention to provide an apparatus for selectively allowing a partial flush of the contents of the water tank into the toilet bowl wherein the apparatus is of simple and inexpensive construction and may be easily added to a conventional toilet without requiring significant modifications thereof.

It is another object of the present invention to provide such a partial flush apparatus which does not affect the flush mechanism typically provided within conventional water tanks when a full flush is desired.

It is still another object of the present invention to provide such a partial flush apparatus compatible with conventional toilets of the type having a flapper valve raised by a chain or other flexible linkage.

It is yet another object of the present invention to provide such a partial flush apparatus wherein substantially all the components thereof are above the level of the water in the tank or are external from the tank in order to minimize corrosion and in order to allow adjustments to be made to the apparatus more conveniently.

It is a further object of the present invention to provide a pneumatic time delay mechanism suitable for use in conjunction with such a partial flush apparatus wherein the predetermined time delay period determined thereby is easily and conveniently adjustable.

It is still a further object of the present invention to provide a pneumatic time delay mechanism suitable for use in conjunction with such a partial flush apparatus wherein the time delay mechanism is of simple and relatively inexpensive construction.

These and other objects of the present invention will become more apparent to those skilled in the art as the description thereof proceeds.

SUMMARY OF THE INVENTION

Briefly described, and in accordance with one embodiment thereof, the present invention relates to a partial flush apparatus for use in conjunction with a conventional toilet and to a pneumatic time delay mechanism suitable for use in conjunction with such apparatus. The partial flush apparatus includes an extension member having a first end secured to the lever arm typically operated by the flush handle of a conventional toilet. The pneumatic time delay mechanism is secured to the water tank external therefrom and includes a slidable plunger biased toward a released position. A cable or other flexible linkage couples the plunger of the pneumatic time delay mechanism to the end of the extension member opposite the lever arm. The pneumatic time delay mechanism allows the plunger to be depressed relatively easily but initially retards movement of the plunger back toward the released position for a predetermined time period. When the plunger of the pneumatic time delay mechanism is depressed by the user, the flexible linkage raises the extension member, thereby raising the flapper valve of the water tank away from its seat and allowing water to be flushed from the water tank into the toilet bowl for the predetermined time delay.

A pneumatic time delay mechanism suitable for use in conjunction with the above described partial flush mechanism preferably includes an elongated fluid container or tube having first and second ends. The plunger slidingly extends into the fluid container through a first end thereof and wipingly engages the inner walls of the fluid container. A spring or other biasing member biases the plunger away from the second end of the fluid container back toward a released position. The plunger includes a valve which allows fluid to pass therethrough when the plunger is moved toward the second end of the fluid container but which prevents the passage of fluid therethrough when the plunger moves back toward the released position. An additional fluid conducting path is formed within the plunger, and a delay member functions to initially restrict the passage of fluid through the fluid conducting path when the plunger is proximate second end of the fluid container in order to retard movement of the plunger back toward the released position.

Preferably, the plunger includes a shaft having a first end external to the fluid container and a second end internal to the fluid container. A sealing member is secured to a portion of the shaft internal to the fluid container for wipingly engaging the inner walls thereof and defining a first region of the fluid container extending between the sealing member and the first end of the fluid container and defining a second region of the fluid container between the sealing member and the second end of the fluid container. The valve incorporated within the plunger allows fluid to pass from the second region to the first region of the fluid container when the shaft is moved toward the second end of the fluid container.

The fluid conducting path formed within the plunger preferably takes the form of a longitudinal bore formed in the second end of the shaft and extending to a point beyond the sealing member; a fluid port formed within the shaft allows fluid to pass between the longitudinal bore and the first region of the fluid container. The delay member may take the form of a metering rod secured to the second end of the fluid container, which metering rod is slidingly received by the longitudinal bore whenever the plunger shaft is moved proximate the second end of the fluid container. The metering rod restricts the passage of fluid through the longitudinal bore from the first region to the second region of the fluid container, thereby retarding movement of the plunger shaft toward the released position, so long as the metering rod extends within the longitudinal bore. A threaded adjustment member is provided for adjusting the depth of penetration of the metering rod within the longitudinal bore of the shaft in order to vary the time delay provided by the pneumatic time delay mechanism.

DETAILED DESCRIPTION OF THE PREFERRED EMBODIMENT

Figure 1:
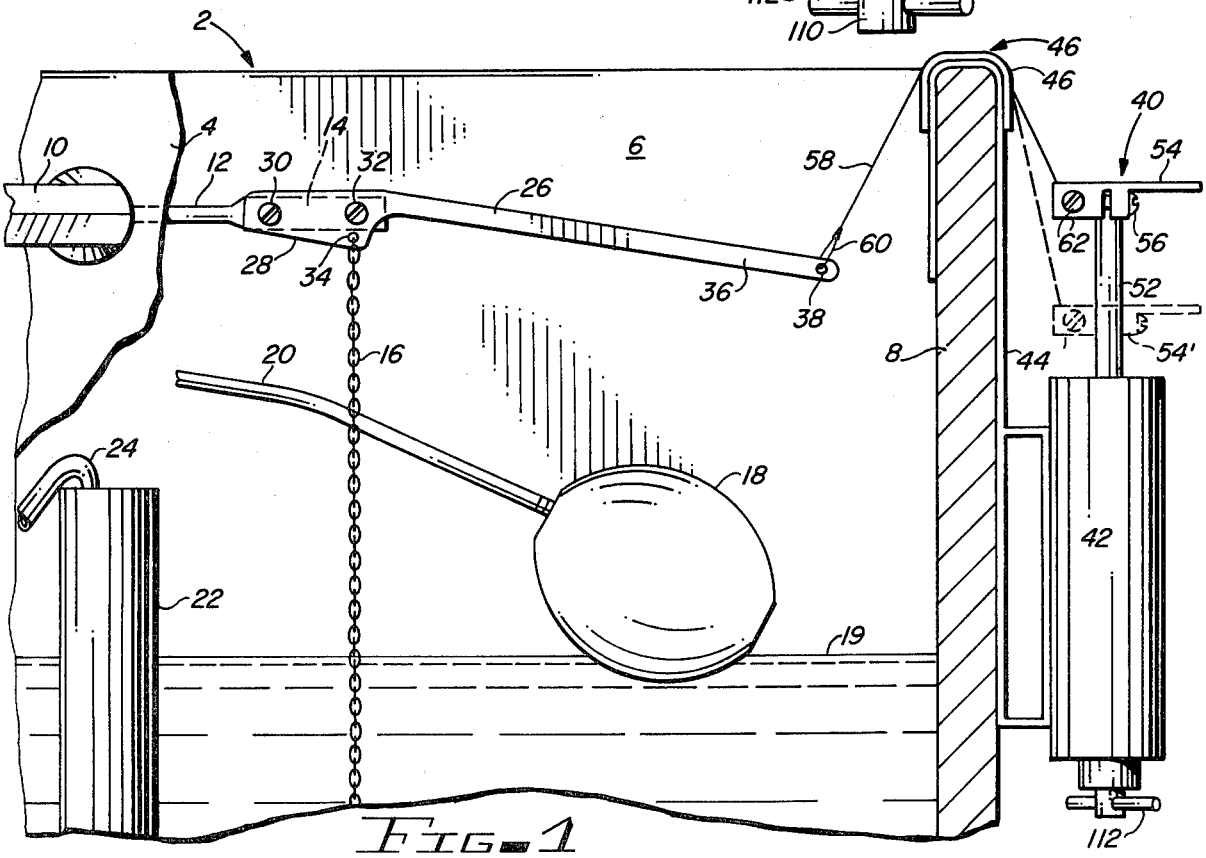
FIG. 1 is a cross-sectional frontal view of the upper portion of a water storage tank for a conventional flush toilet and illustrates the manner in which a partial flush apparatus constructed according to the teachings of the present invention is utilized in conjunction therewith.

In FIG. 1, the upper portion of a water storage tank 2 of a conventional flush toilet is shown including a front wall 4, a rear wall 6, and a pair of side walls, one of which is designated by reference numeral 8. In order to simplify FIG. 1, the tank cover which is normally disposed above and overlies tank 2 has been omitted; in addition, the bottom wall of storage tank 2 and the flapper valve disposed over the drain thereof are not shown. Flush handle 10 is rotatably mounted to the front wall 4 of tank 2 for rotating one end of lever arm 12. The end of lever arm 12 opposite flush handle 10 typically includes a flattened portion (shown in dashed lines designated 14) having a plurality of holes formed therein. Conventional flush mechanisms typically include a chain 16 or other flexible linkage having a hooked upper end for engaging one of the holes within flattened end portion 14 and having a lower end connected to the flapper valve (not shown). As is well known to those skilled in the art, flush handle 10 is rotated counterclockwise for raising flattened end portion 14 which, in turn, raises the flapper valve away from its seat via lift chain 16.

Other conventional components of the toilet tank include float 18 which is buoyantly supported by the water 19 stored within tank 2. Float 18 is connected to one end of a control arm 20, the opposite end of which is used to control a water valve (not shown) that discharges water into tank 2. Standpipe 22 is coupled at its lower end to the tank drain port for preventing the water level within tank 2 from significantly rising above the upper end thereof. Water supply tube 24 has one end thereof coupled to the water discharge valve for receiving water therefrom whenever control arm 20 falls below the position shown in FIG. 1. The end of water supply tube 24 opposite the water discharge valve is inserted within standpipe 22 for partially filling the toilet bowl after each flushing operation.

Still referring to FIG. 1, the partial flush apparatus of the present invention includes an extension member 26 having an end 28 adapted to be secured to the flattened end portion 14 of lever arm 12. End 28 includes a pair of holes formed therein having a diameter and spacing commensurate with the holes already formed within flattened end portion 14. A pair of machine screws 30 and 32 are inserted through respective holes of end 28 and flattened end portion 14 and a pair of nuts (not shown) are threadedly secured over the ends of machine screws 30 and 32 for securing extension member 26 to lever arm 12. An additional hole 34 is formed within end 28 for receiving the hooked upper portion of lift chain 16. Extension member 26 extends from first end 28 to a second end 36 at a downward angle relative to lever arm 12. In this manner, contact between end 36 of extension member 26 and the tank cover, which might otherwise result when flush handle 10 is operated, is avoided. A hole 38 is formed near end 36 of extension member 26, the purpose for which will be described below.

Figure 2:
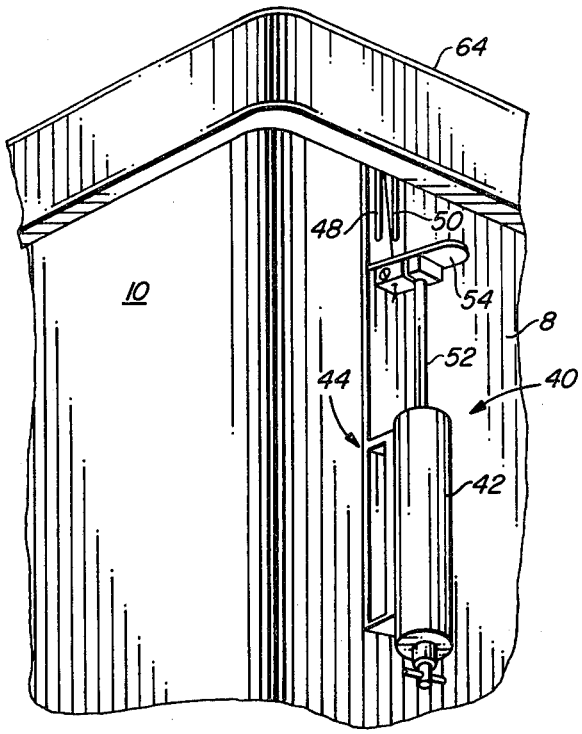
FIG. 2 is a perspective view of the water storage tank showing the manner in which a pneumatic time delay mechanism is secured thereto.

With reference to FIGS. 1 and 2, a pnuematic time delay mechanism, generally designated by reference numeral 40, is disposed adjacent the external face of side wall 8 of tank 2. Pneumatic time delay mechanism 40 includes an elongated fluid container 42 which is a cylindrical metal tube in the preferred embodiment of the present invention. Fluid container 42 is secured to the lower portion of a metallic mounting bracket 44. The upper portion of mounting bracket 44 is formed into a inverted U-shaped flange 46 for engaging the upper edge of side wall 8 and thereby supporting pneumatic time delay mechanism 40 adjacent side wall 8 of water storage tank 2. In addition, a pair of guide rails 48 and 50 are secured to the upper surface of flange 46 for reasons to be described below. Guide rails 48 and 50 may be formed from heavy gauge metal wire bent in conformance with the shape of flange 46 and soldered thereto.

Still referring to FIGS. 1 and 2, pneumatic time delay mechanism 40 includes a plunger shaft 52 which slidingly extends into fluid container 42 from the upper end thereof. An actuator 54 is secured over the upper end of plunger shaft 52 and is clamped thereto by screw 56. Pneumatic time delay mechanism 40 includes a means for biasing plunger shaft 52 and actuator 54 upwardly from a depressed position (shown by dashed lines 54') toward the released position shown in solid lines in FIG. 1.

As shown in FIG. 1, the partial flush apparatus also includes a flexible metal cable 58 which has a hooked end portion 60 inserted through hole 38 of extension member 26. Cable 58 extends over the upper surface of flange 46 between guide rails 48 and 50. The end of cable 58 opposite hooked end 60 is inserted through a vertically disposed hole formed within actuator 54 and clamped thereto by screw 62. Those skilled in the art will appreciate that guide rails 48 and 50 maintain cable 58 centered upon the upper surface of flange 46 as well as maintaining tank cover 64 (see FIG. 2) spaced apart from flange 46 for allowing cable 58 to slide therebetween.

The manner in which the partial flush apparatus of the present invention is utilized will now be described with reference to FIG. 1. If the user wants to empty substantially all of the water stored within storage tank 2 in order to effect a full flush, then flush handle 10 is rotated counterclockwise in the conventional manner for raising flattened end portion 14 of lever arm 12. In this event, lift chain 16 raises the flapper valve to its fully opened position, and the water drains from storage tank 2 in the normal manner. As is known to those skilled in the art, the flapper valve, upon being fully opened, is buoyantly supported away from the valve seat until substantially all of the water drains from water storage tank 2. Although operation of flush handle 10 results in extension member 26 being raised upwardly, this merely results in flexible cable 58 becoming somewhat slackened and does not interfere with the conventional flushing mechanism.

On the other hand, if the user decides that a partial flush will adequately remove waste matter from the toilet bowl, then the user depresses actuator 54 to the position shown by dashed lines 54'. In a manner to be described below, pneumatic time delay mechanism 40 allows plunger shaft 52 to be depressed relatively easily while acting to initially retard movement of plunger shaft 52 back toward its released position. In the preferred embodiment of the present invention, the distance between the released position and fully depressed position of plunger shaft 52 is approximately two and one-half inches. Accordingly, when plunger shaft 52 is depressed, the end of cable 58 secured to actuator 54 is pulled downwardly by approximately two and one-half inches to the dashed line position shown in FIG. 1. In response thereto, any slack in cable 58 is removed, and hooked end 60 of cable 58 is pulled upwardly by approximately two to two and one-half inches. End 36 of extension member 26 is raised by a like amount, causing lever arm 12 to rotate in a counterclockwise direction about the axis of flush handle 10. End 28 of extension member 26 raises by approximately one-half as much as opposite end 36, or about one to one and one fourth inches. Consequently, lift chain 16 is raised by an amount sufficient to partially open the flapper valve, alowing water stored within tank 2 to drain into the toilet bowl for a time determined by pneumatic delay mechanism 40.

As is known to those skilled in the art, flapper valves are buoyant and, when fully opened, will remain in the open position until substantially all of the water has drained from tank 2. However, depressing plunger 52 to its fully depressed causes the flapper valve to become only partially opened; the rate at which water drains past the partially opened flapper valve is insufficient to equalize the water pressure above and below the flapper valve. Accordingly, the pressure exerted by the water within tank 2 continuously urges the flapper valve down toward its seat during operation of the partial flush apparatus. After the predetermined time delay effected by pneumatic time delay mechanism 40 has passed, plunger 52 quickly returns to its released position; in response thereto, extension member 26 falls to its initial position, allowing the flapper valve to reseat itself. Those skilled in the art will appreciate that the amount by which the flapper valve is opened when plunger 52 is depressed can be easily adjusted by temporarily loosening clamp screw 62 and increasing or decreasing the length of cable 58 extending between hooked end 60 and actuator 54.

Figure 3:
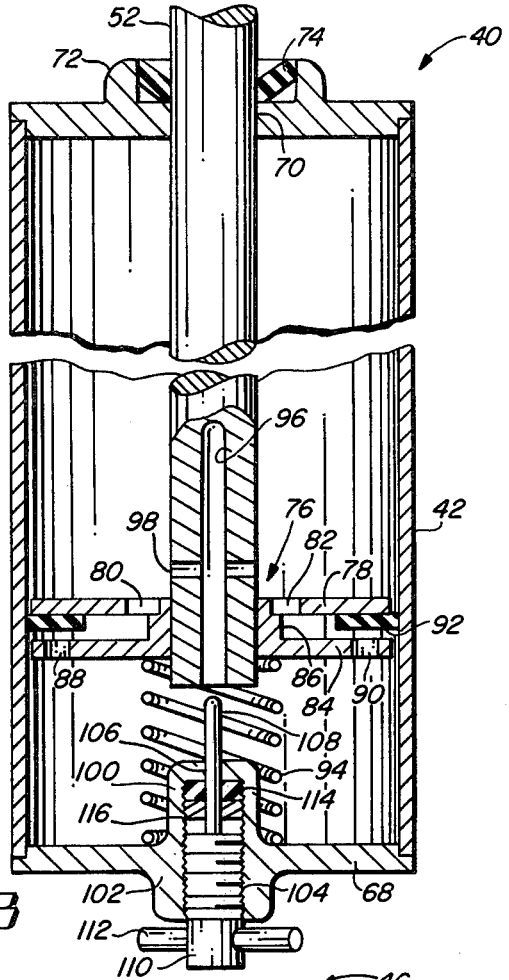
FIG. 3 is a cross-sectional view of a pneumatic time delay mechanism of the type embodying the features of the present invention.

Pneumatic time delay mechanism 40 is shown in greater detail in FIG. 3. Fluid container 42 is preferably formed from one inch diameter brass tubing closed at a first end by a brass plate 66 and closed at a second end opposite the first end by brass plate 68. A fluid, such as hydraulic oil, fills substantially the entire volume bounded by fluid container 42 and end plates 66 and 68. End plates 66 and 68 may be secured to the ends of the tube 42 by any convenient means, for example, by soldering. Preferably, the internal faces of end plates 66 and 68 are recessed to fit within tube 42. A central bore is formed within end plate 66 in order to form a bearing surface for slidingly receiving plunger shaft 52. The outer face of end plate 66 includes a raised ring portion 72 encircling plunger shaft 52, and a press fit lip-type neoprene seal 74 is disposed within ring portion 72 in wiping engagement with plunger shaft 52. Neoprene seal 74 prevents hydraulic fluid from escaping from tube 42 when plunger shaft 52 moves outwardly.

Still referring to FIG. 3, the end portion 76 of plunger shaft 52 extending within tube 42 is externally threaded. A first circular valve plate 78, the outer diameter of which is commensurate with the inner diameter of tube 42, has a threaded hole formed centrally therein for threadedly engaging end portion 76 of plunger shaft 52. In addition, a plurality of holes 80 and 82 are formed within first valve plate 78 proximate plunger shaft 52. A second circular valve plate 84, the outer diameter of which is also commensurate with the inner diameter of tube 42, also has a threaded hole formed centrally therein for threadedly engaging end portion 76 of plunger shaft 52. Valve plate 84 includes a boss 86 proximate plunger shaft 52 for maintaining valve plate 84 spaced apart from valve plate 78. A plurality of holes 88 and 90 are formed within valve plate 84 near the outer periphery thereof.

Disposed between valve plates 78 and 84 is a circular neoprene sealing washer 92 having an outer diameter slightly in excess of the inner diameter of tube 42, the outer periphery of sealing washer 92 being in wiping engagement with the inner walls of tube 42. Sealing washer 92 is adapted to slide past the inner walls of tube 42 when plunger shaft 52 is moved while remaining in wiping engagement therewith. The inner diameter of sealing washer 92 is selected such that sealing washer 92 overlies holes 88 and 90 within valve plate 84 whenever sealing washer 92 is adjacent thereto while avoiding any overlap with holes 80 and 82 within valve plate 78.

Valve plates 78 and 84 and sealing washer 92 divide fluid tube 42 into first and second fluid containing regions. The first region extends from end plate 66 to valve plate 78, while the second region extends from end plate 68 to valve plate 84. When plunger shaft 52 is depressed toward end plate 68, sealing washer 92 lies adjacent valve plate 78. Accordingly, fluid within the second region of tube 42 freely passes through holes 88 and 90 in valve plate 84 and through holes 80 and 82 within valve plate 78, thereby passing into the first region of tube 42. However, when plunger shaft 52 is moved away from end plate 68, sealing washer 92 lies adjacent valve plate 84 and seals holes 88 and 90 therein. Consequently, fluid within the first region of tube 42 is prevented from passing through valve plate 84 into the second region of tube 42. Therefore, valve plates 78 and 84 and sealing washer 92 cooperate to form a one-way valve which facilitates movement of plunger shaft 52 toward end plate 68 but which does not facilitate movement of plunger shaft 52 in the opposite direction. The one-way valve formed by valve plates 78 and 84 and sealing washer 92 has been found to be superior in performance over conventional cup leather valves known in the art.

Still referring to FIG. 3, compressible coil spring 94 extends between end plate 68 and the lower surface of valve plate 84 for biasing plunger shaft 52 away from end plate 68. In order to facilitate movement of plunger shaft 25 away from end plate 68 under the biasing force of spring 94, a fluid conducting path is formed within plunger shaft 52 for conducting fluid from the first region of tube 42 to the second region thereof. The fluid conducting path includes a longitudinal bore 96 which extends through the end portion 76 of plunger shaft 52 to a point extending above valve plate 78. A transverse bore 98 is formed within plunger shaft 52 above valve plate 78 to form a fluid port coupling longitudinal bore 96 to the first region of fluid tube 42.

As shown in FIG. 3, end plate 68 includes an upper, internal boss 100 and a lower external boss 102. The upper face of boss 100 contacts end portion 76 of plunger shaft 52 whenever plunger shaft 52 is fully depressed; hence, the upper face of boss 100 serves as a limit stop for limiting downward movement of plunger shaft 52. A threaded bore 104 is formed within end plate 68 extending through boss 102 and partially through boss 100. A smaller smooth bore 106, concentric with bore 104, extends from the innermost end of bore 104 through the upper face of boss 100.

Metering rod 108 extends through bore 106 and is directed toward longitudinal bore 96 within plunger shaft 52 for being slidingly received thereby when plunger shaft 52 is depressed. Metering rod 108 is secured to a threaded adjustment shaft 110 which threadedly engages bore 104. A section of metal rod is press fit through a transverse bore at the lower end of adjustment shaft 110 for providing a handle used to rotate adjustment shaft 110. Those skilled in the art will appreciate that by rotating adjustment shaft 110, the distance by which metering rod 108 extends above the upper face of boss 100, and hence the distance by which metering rod penetrates longitudinal bore 96, can be varied. A neoprene packing washer 114 is held in place against the innermost end of bore 104 by an externally threaded packing nut 116 for preventing leakage of hydraulic fluid past metering rod 108. Packing nut 116 is advantageously provided with a transverse slot for receiving the tip of a screwdriver which may be used to fully advance packing nut 116 into bore 104.

The operation of pneumatic time delay mechanism 40 will now be described with reference to FIG. 3. Plunger shaft 52 is initially in a released position wherein end portion 76 of plunger shaft 52 extends approximately two and one-half inches above the upper face of boss 100. In order to actuate time delay mechanism 40, plunger shaft 52 is fully depressed until end portion 76 contacts the upper face of boss 100, thereby compressing spring 94. As plunger shaft 52 is depressed, fluid in the second region of tube 42 passes through valve plates 78 and 84 into the first region of tube 42. Fluid within the first region of tube 42 also passes through longitudinal bore 96 and transverse bore 98 to the first region of tube 42 until metering rod 108 begins to penetrate longitudinal bore 96.

When downward force is no longer applied to plunger shaft 52, biasing spring 94 urges plunger shaft 52 back toward the released position. However, upward movement of plunger shaft 52 causes sealing washer 92 to close off fluid passages 88 and 90 within valve plate 84. Accordingly, the only path by which fluid within the first region of tube 42 can pass to the second region thereof is the constricted space between longitudinal bore 96 and metering rod 108. In the preferred embodiment of the present invention, the clearance between metering rod 108 and longitudinal bore 96 is approximately 0.005 inch. Thus, the fluid conducting path formed by longitudinal bore 96 and transverse bore 98 is substantially restricted so long as metering rod 108 extends within longitudinal bore 96; consequently, movement of plunger shaft 52 back toward its released position is retarded until plunger shaft 52 has moved sufficiently far away from end plate 68 as to avoid penetration of longitudinal bore 96 by metering rod 108. By rotating adjustment shaft 110, the distance by which metering rod 108 initially penetrates longitudinal bore 96 can be selected to retard movement of plunger shaft 25 toward the released position for any desired predetermined time delay. Once longitudinal bore 96 of plunger shaft 52 is free of metering rod 108, plunger shaft 52 quickly returns to its initially released position.

It will now be appreciated by those skilled in the art that a partial flush apparatus has been described which is of simple and inexpensive construction and which apparatus can be easily added to a conventional toilet flushing mechanism without affecting the normal full flush operating mode thereof. The described partial flush apparatus is compatible with all types of conventional toilet flush mechanisms including those utilizing a flapper valve and a lift chain or other flexible lift linkage. None of the components of the partial flush apparatus are submersed within the water held by the tank, and corrosion of the components of the partial flush apparatus is thereby minimized. Those skilled in the art will also appreciate that a pneumatic time delay mechanism has been described which is suitable for use in conjunction with the partial flush apparatus. The pneumatic time delay mechanism initially retards movement of a depressible plunger from a depressed position to a released position for an adjustably determined time period, following which the plunger is quickly returned to the released position.

While the present invention has been described with reference to a predetermined embodiment thereof, the description is for illustrative purposes only and is not to be construed as limiting the scope of the invention. For example, the above described pneumatic time delay mechanism may be used in a wide variety of applications apart from the partial flush apparatus described herein. Various modifications and changes may be made by those skilled in the art without departing from the true spirit and scope of the invention as defined by the appended claims.

I claim:

1. A partial flush apparatus for use in conjunction with a conventional toilet of the type having a water tank, a flapper valve mounted at the bottom of the water tank, a flush handle, a lever arm disposed within the water tank and having a first end connected to the flush handle and having a second end opposite the first end, and a first flexible linkage coupling the flapper valve to the second end of the lever arm for raising the flapper valve when the flush handle is operated, said partial flush apparatus comprising in combination:

a. pneumatic time delay means secured to said water tank substantially external therefrom, said pneumatic time delay means including a plunger slidingly extending therein and biased toward a released position, said plunger having an actuator operated by the user apart from said flush handle for depressing said plunger from the released position to a depressed position, said pneumatic time delay means retarding the return of said plunger from the depressed position to the released position for a predetermined time; and b. coupling means for coupling the second end of said lever arm to said plunger in order to raise the second end of the lever arm for partially opening the flapper valve for the predetermined time whenever the user actuates said plunger, said coupling means including a second flexible linkage which is made taut when said plunger is depressed and which is slackened when said flush handle is operated for preventing said pneumatic time delay means from interfering with the normal operation of said lever arm when said flush handle is operated.

2. A partial flush apparatus as recited in claim 1 wherein said coupling means further includes:

a. an extension member having a first end secured to the second end of the lever arm and having a second end opposite the first end thereof; and b. said second flexible linkage couples the second end of said extension member to said plunger.

3. A partial flush apparatus as recited in claim 2 wherein said extension member extends at a downward angle from the lever arm to avoid contacting the second end of said extension member with a water tank cover when the flush handle is operated by the user.

4. A partial flush apparatus as recited in claim 2 wherein said second flexible linkage comprises a cable.

5. A partial flush apparatus as recited in claim 4 including adjustment means for adjusting the length of the cable extending between the second end of said extension member and said plunger in order to adjust the amount by which the flapper valve is opened when said plunger is actuated.

6. A partial flush apparatus as recited in claim 1 wherein said pneumatic time delay means includes adjustment means for adjusting the predetermined time that said pneumatic time delay means retards the return of said plunger from the depressed position to the released position.

7. A partial flush apparatus as recited in claim 1 including a mounting bracket secured to said pneumatic time delay means and having an inverted u-shaped flange at the upper portion thereof for engaging an upper edge of the water tank in order to support said pneumatic time delay means adjacent an outer vertical wall of the water tank.

8. A partial flush apparatus as recited in claim 7 including guide means secured to the upper surface of said flange for guiding said second flexible linkage over the upper surface of said flange, said guide means maintaining a water tank cover spaced apart from the upper surface of said flange for allowing said second flexible linkage to freely move therebetween.

9. A partial flush apparatus as recited in claim 1 wherein said pneumatic time delay means includes:

an elongated fluid container having first and second ends and a containing wall extending therebetween for containing a fluid, said containing wall having an inner surface;

and wherein said plunger includes:

a. a shaft slidingly extending through the first end of said fluid container, said shaft having a first end external to said fluid container and a second end internal to said fluid container; and b. sealing means disposed wherein said fluid container and secured to said shaft for sliding movement therewith, said sealing means wipingly engaging the inner surface of said fluid containing wall and defining a first region of said fluid container between said sealing means and the first end of said fluid container and a second region of said fluid container between said sealing means and the second end of said fluid container;

c. a valve allowing fluid to pass therethrough from the second region of said fluid container to the first region thereof when said shaft is moved toward the second end of said fluid container to facilitate movement of said shaft toward the second end of said fluid container and substantially preventing fluid from passing therethrough when said plunger means is moved away from the second end of said fluid container to oppose movement of said shaft toward the first end of said fluid container; and d. means for providing a fluid conducting path for conducting fluid from the first region of said fluid container to the second region thereof;

said pneumatic time delay means further including:

a. biasing means for biasing said plunger away from the second end of said fluid container toward the first end thereof; and b. delay means secured to said fluid container and cooperating with said plunger for restricting the passage of fluid through said fluid conducting path when said plunger is proximate the second end of said fluid container in order to retard movement of said plunger away from the second end of said fluid container toward the first end thereof in response to said biasing means for a predetermined time.

10. A partial flush apparatus as recited in claim 9 wherein said sealing means comprises an elastic sealing washer concentric with said shaft and wherein said valve includes first and second plates secured to said shaft perpendicular thereto and parallel to each other in spaced apart relationship, said sealing washer being disposed between said first and second plates, each of said first and second plates having apertures therein for passing fluid therethrough, said sealing washer being effective to seal the apertures within at least one of said first and second plates in order to prevent the passage of fluid therethrough when said shaft is moved away from the second end of said fluid container.

11. A partial flush apparatus as recited in claim 9 wherein said means for providing a fluid conducting path includes a longitudinal bore formed within said shaft and extending from the second end of said shaft to a point beyond said sealing means, said means for providing a fluid conducting path also including a fluid port formed within said shaft for effecting fluid communication between the longitudinal bore and the first region of said fluid container, the longitudinal bore and said fluid port forming said fluid conducting path.

12. A partial flush apparatus as recited in claim 11 wherein said delay means includes a metering rod secured to the second end of said fluid container directed toward the longitudinal bore of said shaft for being slidingly received thereby when the second end of said shaft is moved proximate to the second end of said fluid container, said metering rod restricting the passage of fluid through the longitudinal bore of said shaft in order to retard the passage of fluid from the second region to the first region of said fluid container so long as said metering rod extends within the longitudinal bore of said shaft.

13. A partial flush apparatus as recited in claim 12 including adjustment means for varying the amount by which said metering rod penetrates the longitudinal bore of said shaft when said shaft is moved proximate the second end of said fluid container, in order to adjust the time required for said shaft to move away from the second end of said fluid container.

14. A partial flush apparatus as recited in claim 13 wherein said adjustment means comprises a rotatable member extending into the second end of said fluid container and threacedly secured thereto for supporting said metering rod, rotation of said rotatable member effecting a variation in the position of said metering rod relative to the second end of said fluid container.

* * * * *